US006226835B1

(12) United States Patent
Cress

(10) Patent No.: US 6,226,835 B1
(45) Date of Patent: May 8, 2001

(54) HINGE

(75) Inventor: David R. Cress, Janesville, WI (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/394,800

(22) Filed: Sep. 10, 1999

(51) Int. Cl.[7] ..... E05F 1/08

(52) U.S. Cl. ..... 16/260; 16/255

(58) Field of Search ..... 16/254, 255, 260–263, 16/272, 237, 240, 382, 383, 286, 297, 303, 335; 403/330, 161

(56) References Cited

U.S. PATENT DOCUMENTS

| | | | | |
|---|---|---|---|---|
| 314,641 | | 3/1885 | Andrews . | |
| 406,730 | | 7/1889 | Harvie . | |
| 557,602 | | 4/1896 | Pletcher . | |
| 2,430,311 | | 11/1947 | Thiele . | |
| 2,526,209 | | 10/1950 | Durup . | |
| 3,103,378 | | 9/1963 | Ahlgren . | |
| 3,418,682 | | 12/1968 | Anderson . | |
| 3,716,815 | | 2/1973 | Riches . | |
| 3,724,021 | | 4/1973 | Lautenschläger . | |
| 3,864,786 | | 2/1975 | Salice . | |
| 4,063,330 | | 12/1977 | Triplette . | |
| 4,099,293 | * | 7/1978 | Pittasch | 16/258 X |
| 4,240,179 | | 12/1980 | Lautenschläger . | |
| 4,247,965 | | 2/1981 | Lautenschläger . | |
| 4,506,409 | | 3/1985 | Lautenschläger . | |
| 4,675,941 | | 6/1987 | Grass . | |
| 4,716,622 | | 1/1988 | DeBruyn . | |
| 4,731,903 | * | 3/1988 | Kennedy et al. | 16/382 X |
| 4,979,264 | * | 12/1990 | Ramsauer | 16/387 |
| 5,027,474 | | 7/1991 | Bowers . | |
| 5,355,557 | * | 10/1994 | Cress et al. | 16/286 |
| 5,655,261 | | 8/1997 | Cress . | |
| 5,839,164 | | 11/1998 | Cress et al. . | |
| 5,898,976 | * | 5/1999 | Leonardi, Sr. et al. | 16/278 |
| 5,979,016 | * | 11/1999 | Fan | 16/386 X |
| 6,099,097 | * | 8/2000 | Hocker et al. | 16/257 X |

* cited by examiner

*Primary Examiner*—Robert J. Sandy
(74) *Attorney, Agent, or Firm*—Foley & Lardner

(57) ABSTRACT

A hinge used to mount a cabinet door to a frame is disclosed. The hinge is a fully concealed cabinet hinge having a mounting cup. The mounting cup is configured to be received in a bore in a cabinet door. The mounting cup is pivotally attached to a frame member. The frame member is mounted to the cabinet frame. The door member is a flexible member having a receiving area for a pivot. The door member may be flexed to open the receiving area to receive and capture a pivot so that the hinge may be assembled by hand.

33 Claims, 10 Drawing Sheets

FIG. 3
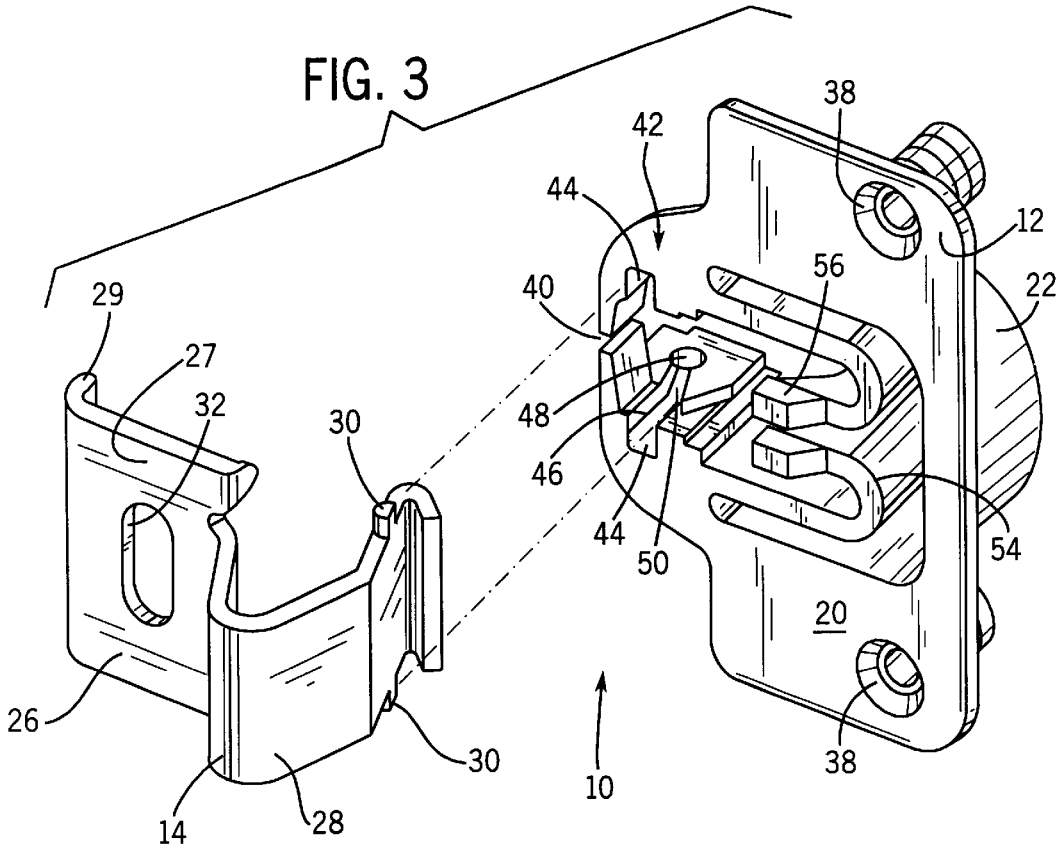
FIG. 5
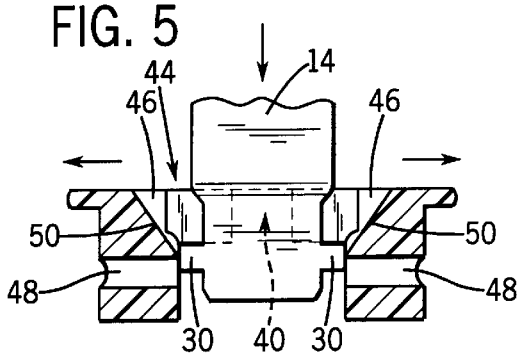
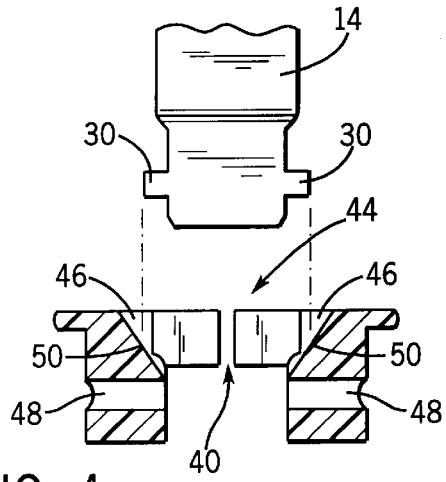
FIG. 4
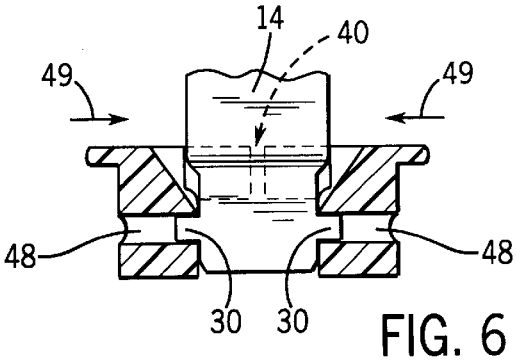
FIG. 6

FIG. 8
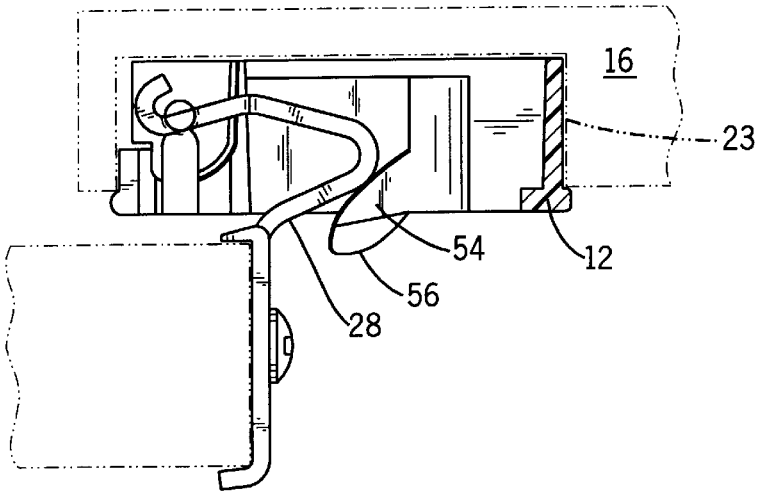
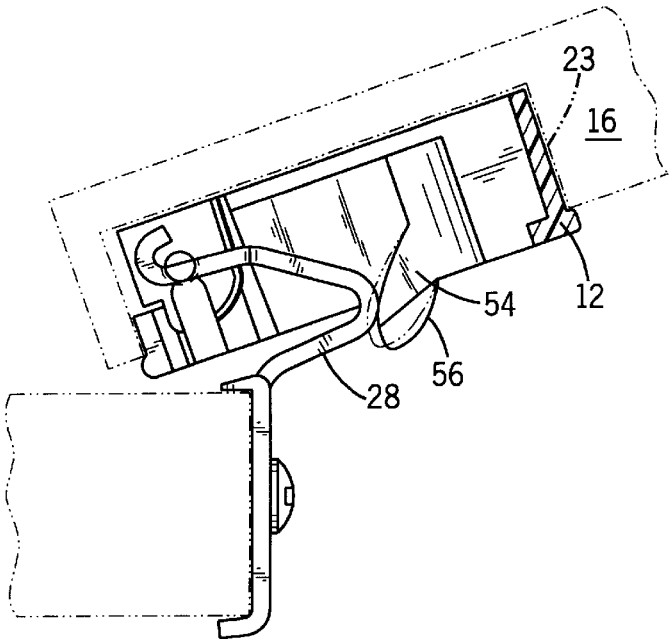
FIG. 9
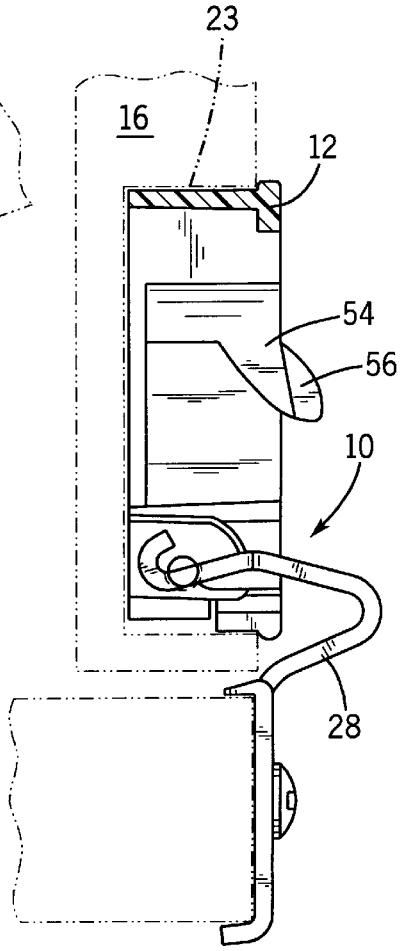
FIG. 10

FIG. 11
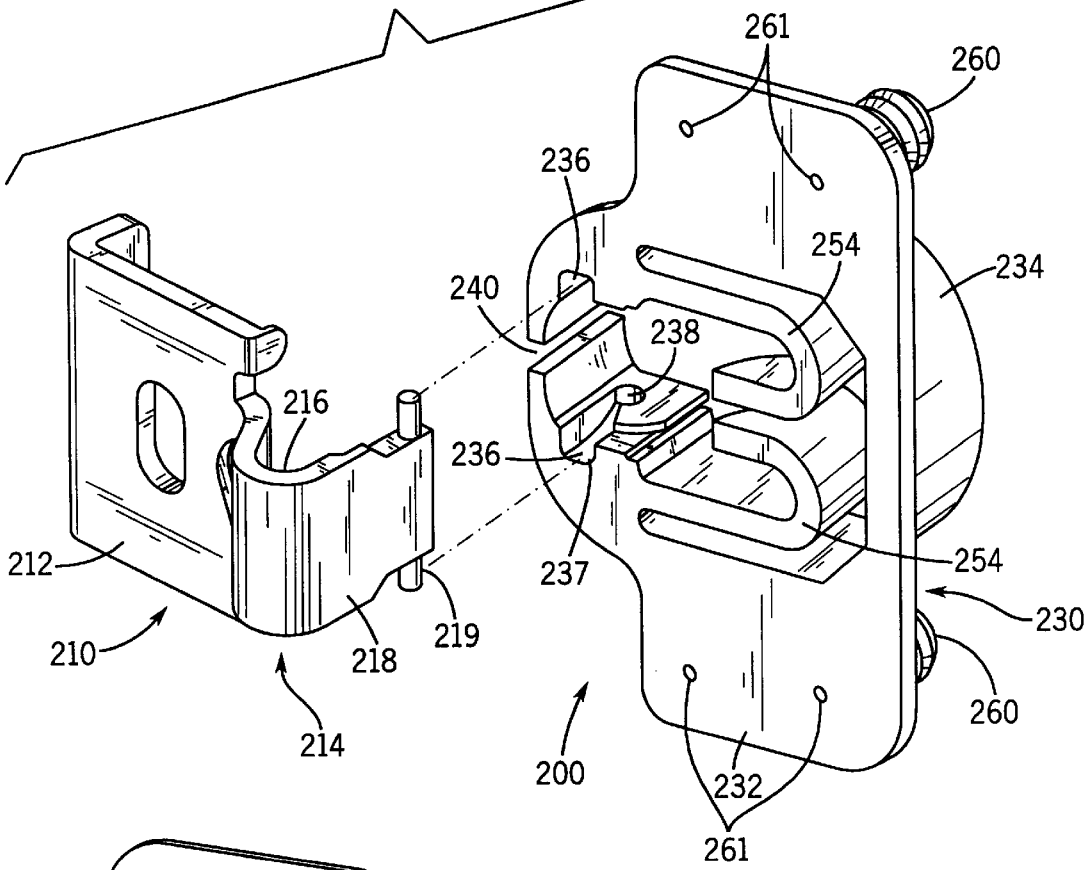
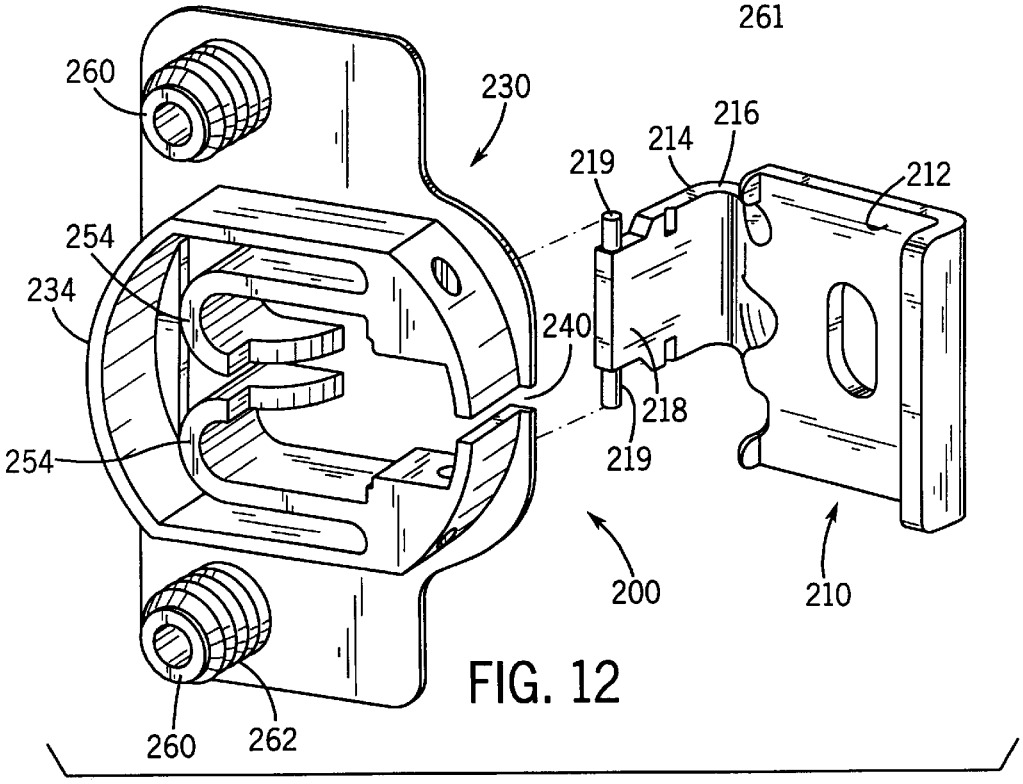
FIG. 12

FIG. 13
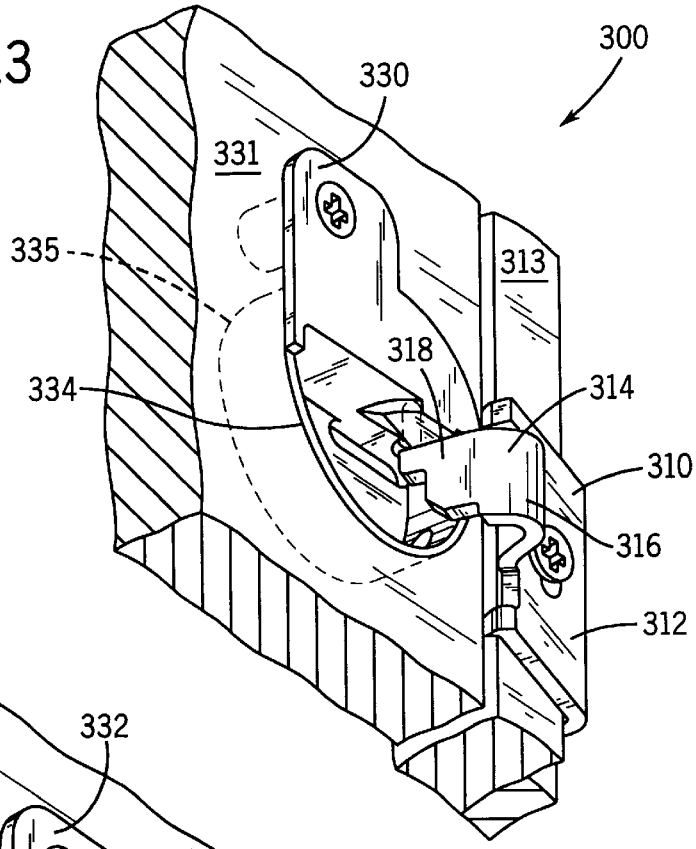
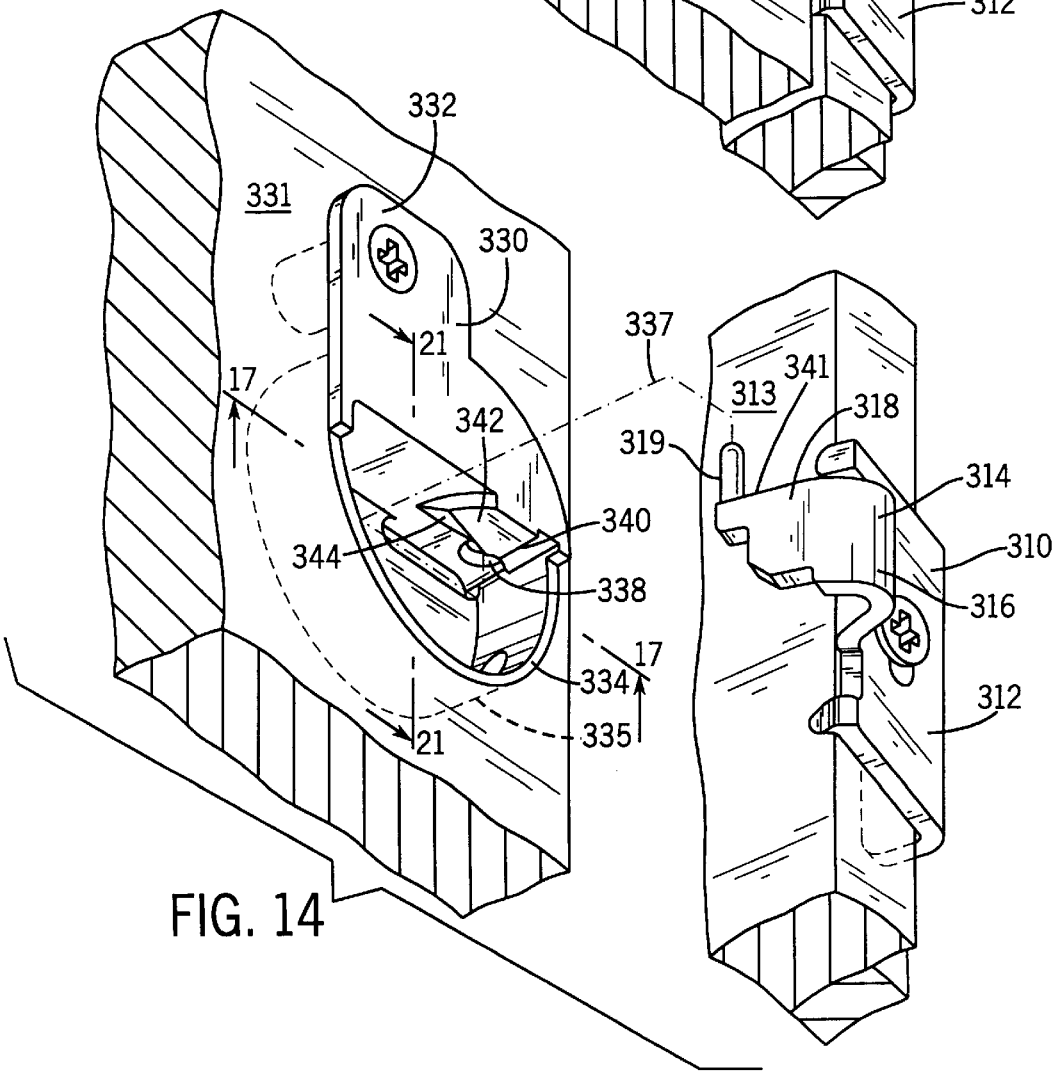
FIG. 14

FIG. 15
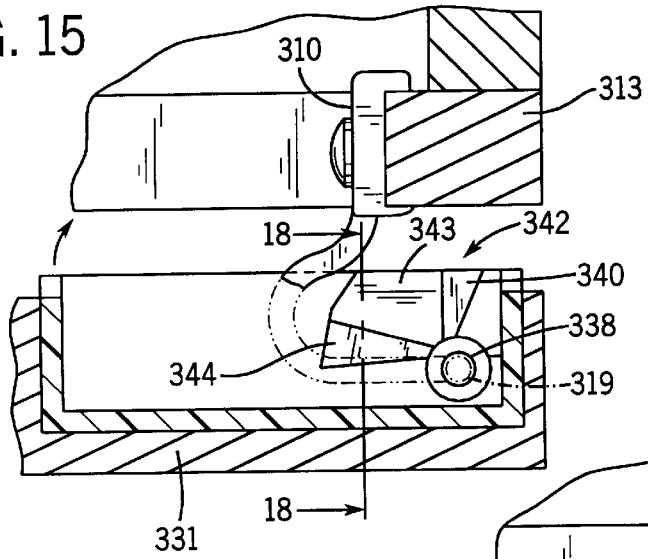
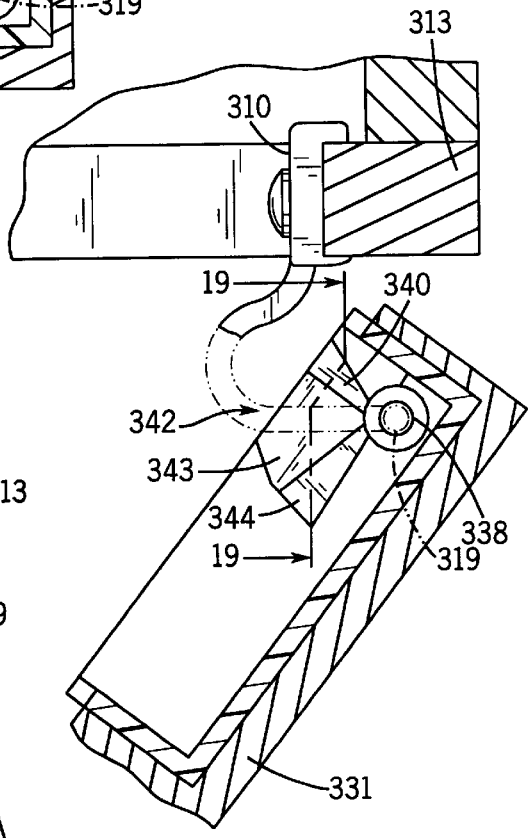
FIG. 16
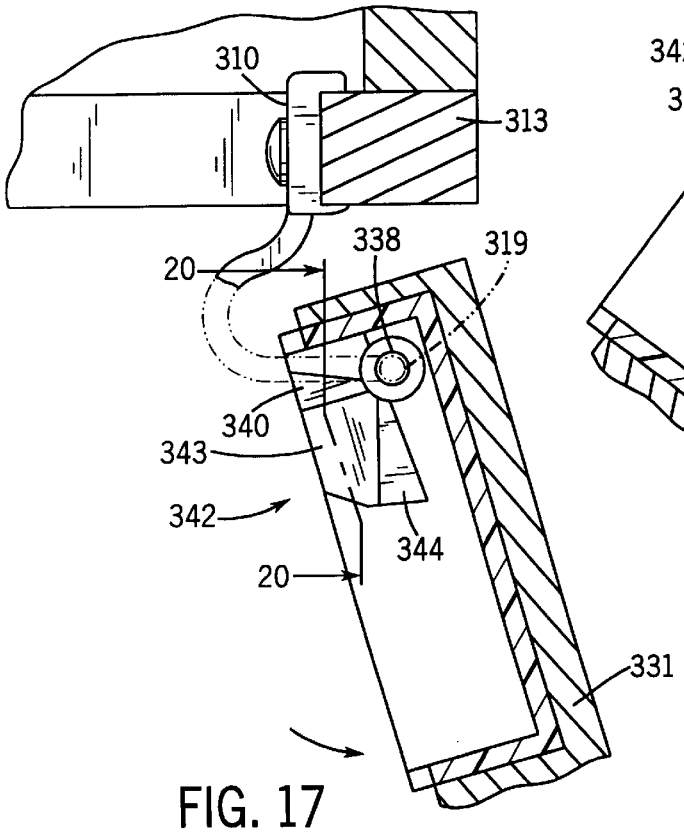
FIG. 17

HINGE

FIELD OF THE INVENTION

The present invention relates to a hinge used to mount a cabinet door to a frame. The present invention particularly relates to a concealed cabinet hinge having a mounting cup that is received in a bore in a cabinet door and pivotally attached to a frame wing that is mounted to the cabinet frame. The present invention also particularly relates to a process for assembling the hinge.

BACKGROUND OF THE INVENTION

There are many known types of hinges that allow a door to be mounted to a frame. One type is a concealed self-closing/self-latching hinge of the type disclosed in U.S. Pat. No. 5,233,726 entitled "Self-Closing/Self-Latching Hinge," issued to Cress on Aug. 10, 1993, incorporated by reference herein. Such concealed self-closing/self-latching hinges pivotally couple a cabinet door to a frame and provide for "self-closing" and "self-latching" effects, as described in U.S. Pat. No. 5,233,726. Concealed hinges have grown in popularity because of the aesthetic appeal of cabinets is often considered to be enhanced if hinges are not visible (i.e., when the cabinet door is closed). Such hinges have a two part arrangement, with one part of the hinge coupled to the door and the other part of the hinge coupled to the frame. Concealed hinges of this type are commonly assembled using a separate hinge pin that is inserted to pivotally couple each part of the hinge during the manufacturing process, which may present difficulties for a cabinet installer during installation of the hinge (i.e., the cabinet door to the frame) in a particular application.

Accordingly, it would be advantageous to provide for a hinge having a door member configured to be mounted on a cabinet door and a frame member configured to be mounted to a cabinet frame that may thereafter be pivotally coupled during installation of the hinge (i.e., the door to the frame). It would also be advantageous to provide for a hinge that allows an installer to conveniently couple the door member to the frame member by hand during assembly and/or disassembly. It would further be advantageous to provide for a self-closing and/or self-latching hinge configured for pivotal coupling of the door member to the frame member during installation of the hinge.

SUMMARY OF THE INVENTION

The present invention relates to a hinge for mounting a door to a frame. The hinge includes a door member configured to be mounted on the door and a frame member pivotally coupled to the door member by a pivot. The door member has a receiving area configured to receive the pivot. The door member and the frame member are configured to be assembled by spreading open the receiving area to allow passage of the pivot into the receiving area.

The present invention also relates to a hinge for mounting a door to a frame. The hinge includes a flexible door member configured to be mounted on the door and a frame member pivotally coupled to the door member by a pivot. The door member has an aperture that is configured to allow the door member to be flexed from a substantially first state to a deformed state for insertion of the pivot into the door member. The door member may be moved to the substantially nominal state after insertion of the pivot to capture the pivot.

The present invention further relates to a method for assembling a hinge. The method includes enlarging a receiving area in a door member to allow passage of a pivot coupled to a frame member. The method also includes inserting the pivot of the frame member into the receiving area of the door member. The method further includes causing the door member to substantially retain its nominal shape to capture the pivot of the frame member in the receiving area of the door member.

The present invention still further relates to a hinge. The hinge includes a door member configured to be coupled to a door and a frame member configured to be coupled to a frame. A cam surface is provided on one of the door member and the frame member, the cam surface engageable with the other of the door member and the frame member, the cam surface configured to develop at least a partial closing force of the door relative to the frame. The door member and the frame member are configured to be selectively pivotally coupled and decoupled.

BRIEF DESCRIPTION OF THE DRAWINGS

The invention will become more fully understood from the following detailed description, taken in conjunction with the accompanying drawings, wherein like reference numerals refer to like parts, in which:

FIG. 3 is a perspective view of the hinge prior to assembly of the frame member and the door member.

FIG. 4 is a partial cross sectional side view of the door member illustrating the pivot prior to insertion into the door member.

FIG. 5 is a partial cross sectional side view of the door member depicting the frame member being inserted into the door member.

FIG. 6 is a partial cross sectional side view of the door member depicting the pivot captured in the door member.

FIG. 8 is a partial cross sectional view of the door member of FIG. 1 illustrating the hinge in a closed position.

FIG. 9 is a partial cross sectional top view of the door member of FIG. 1 illustrating the hinge in a partially closed position.

FIG. 10 is a partial cross sectional top view of the door member of FIG. 1 depicting the hinge in an open position.

FIG. 11 is an exploded front perspective view of an alternative embodiment of the hinge.

FIG. 12 is an exploded rear perspective view of the hinge of FIG. 11.

FIG. 13 is a perspective view of an alternative embodiment of the hinge.

FIG. 14 is an exploded perspective view of the hinge of FIG. 13.

FIG. 15 is a bottom view of the hinge of FIG. 13 depicting the door in a closed position.

FIG. 16 is a bottom view of the hinge of FIG. 13 depicting the door in a partially open position.

FIG. 17 is a bottom view of the hinge of FIG. 13 depicting the door in a fully open position.

DETAILED DESCRIPTION OF THE PREFERRED EMBODIMENTS

Figure 1:
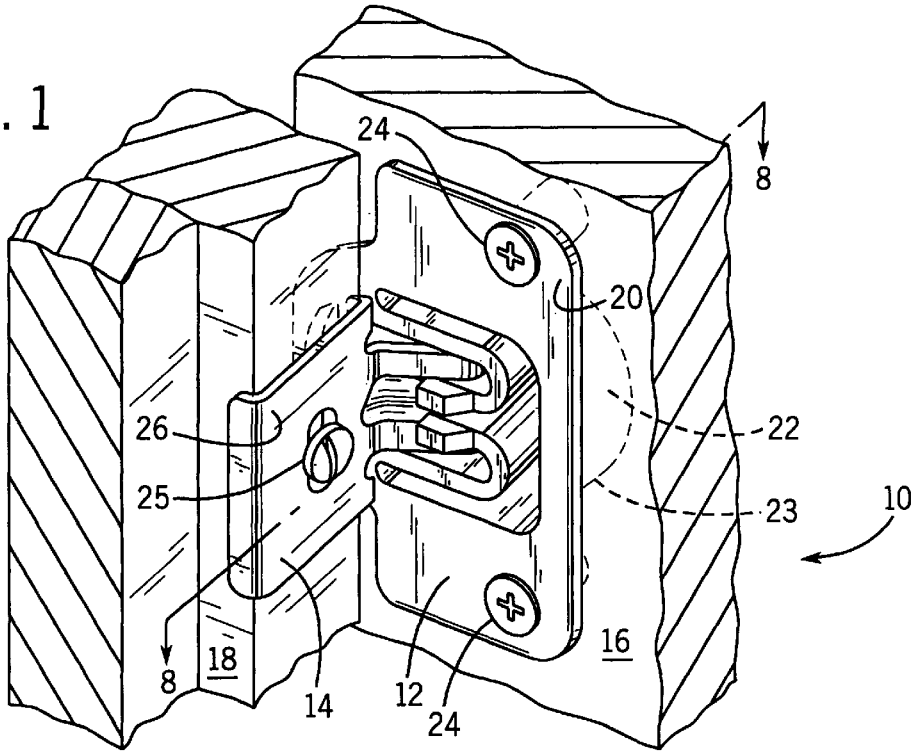
FIG. 1 is a perspective view of a concealed self-closing/self-latching hinge mounted on a door and a frame in accordance with a preferred embodiment of the invention.
Figure 2:
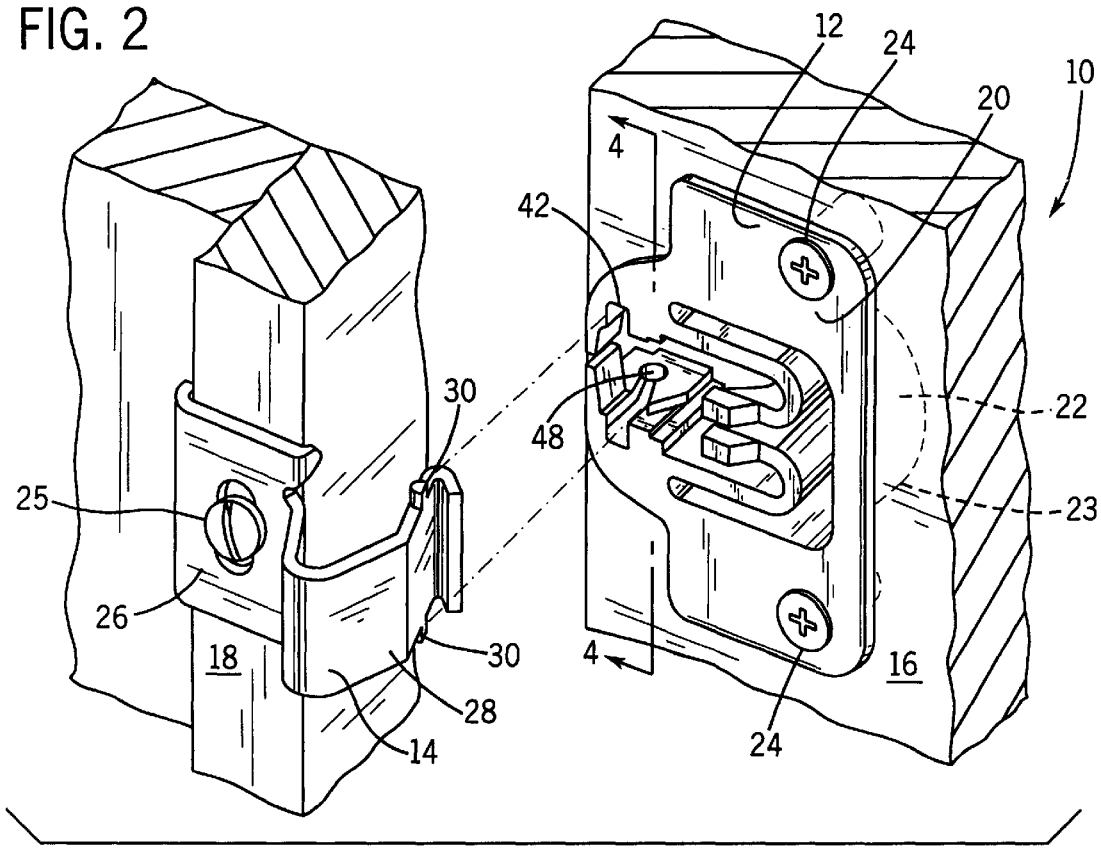
FIG. 2 is a perspective exploded view of the hinge of FIG. 1.

Referring now to FIGS. 1 and 2, a hinge 10 is depicted having a door member 12 and a frame member 14. Hinge 10 is configured to pivotally couple a door 16 to a frame 18. Door member 12 preferably includes a mounting flange 20 and a mounting cup 22. Mounting flange 20 couples door member 12 to door 16 via fasteners, such as screws 24 (alternatively, molded on fasteners, such as integrally formed dowels may be used to replace screw fasteners). Mounting cup 22 fits into a recess or bore 23 in door 16.

According to a preferred embodiment of the present invention, frame member 14 is a single element comprising a frame wing 26 and a hinge arm 28. Alternatively, however, frame wing 26 and hinge arm 28 may be separate members that are coupled together. According to a preferred embodiment, frame member 14 is coupled to frame 18 by a fastener, such as screw 25.

Referring now to FIG. 2, door member 12 and frame member 14 are depicted separated to indicate how frame member 14 is coupled to door member 12. As depicted in FIG. 2, a receiving area 42 is configured to accept pivots, shown as posts 30. Posts 30 are inserted through receiving area 42 and retained by pivot recesses 48. Pivot recesses 48 may be configured as vertically extending holes or other applicable configuration.

Referring now to FIG. 3, hinge 10 is depicted as including frame member 14 and door member 12. Generally, frame member 14 is formed from a single piece of hardened steel including frame wing 26 and hinge arm 28. Alternatively, however, frame member 14 may be manufactured from a variety of materials including, but not limited to, metal and metal alloys, ceramics, polymers, and composite materials. According to a preferred embodiment, frame wing 26 is configured with a planar surface 27 having a lip 29. Frame wing 26 includes a slotted aperture 32. Slotted aperture 32 is oriented to allow vertical adjustment of hinge 10. In alternative embodiments, the slotted aperture may be oriented in any direction to allow adjustment in a variety of directions, or may have a variety of geometric configurations including oval slots, circular slots, crossed slots, rectangular slots, or any other applicable slot geometry. Frame wing 26 is preferably coupled to a hinge arm 28 at an end opposite lip 29.

According to a preferred embodiment, hinge arm 28 is a J-shaped (or L-shaped) hinge arm. An integral pivot, such as integral posts 30 extend from the end of hinge arm 28 opposite to frame wing 26. The pivot may be provided by any of a variety of pivotable couplings including but not limited to the integral posts 30, as depicted in FIG. 3, separate pivot pins, pivot nubs or bumps, pintles, or any other of a variety of pivot mechanisms or arrangements. According to alternative embodiments, the door member may have posts and the frame member may have pivot recesses.

Door member 12 includes mounting flange 20, screw fastener apertures 38 (alternatively screw fastener apertures 38 may be replaced by integrally formed dowels or integrally formed fasteners or split dowels which split apart to create a greater holding force, when a screw is inserted), mounting cup 22, assembly aperture 40, a receiving area 42, a slot 44, grooves 46, pivot recesses 48, ramps 50, spring arms 54 and detent lugs 56. According to a preferred embodiment, mounting flange 20 is a flat surface suitable for mounting on a door 16, shown in FIGS. 1 and 2. Fastener apertures 38 are located on the flat surface of mounting flange 20 such that screws 24 (see FIGS. 1 and 2) do not interfere with mounting cup 22. Mounting cup 22 extends from the plane of mounting flange 20 having a central axis that is substantially perpendicular thereto. Mounting cup 22 is generally cylindrical in shape, however, according to alternative embodiments, other shapes or arrangements of the mounting cup may be used. The substantially cylindrical mounting cup 22, as depicted in FIG. 3 includes a perimeter which is not fully continuous because of assembly aperture 40. According to an alternative embodiment, the door member may be manufactured as two or more separate parts so that the two or more parts can be assembled to capture the posts. A two-part door member may be fastened together or may be captured by a bore, such as bore 23 in door 16.

Mounting cup 22 provides an interior receiving area 42. According to a preferred embodiment, receiving area 42 is located near the perimeter of door member 12 such that hinge arm 28 pivots on posts 30 into door member 12 when door 16 is being closed. According to a preferred embodiment, receiving area 42 includes a slot 44, extending from the surface of mounting flange 20 into mounting cup 22. Slot 44 may be made of opposing grooves 46 with opposing pivot recesses 48 at the bottom of slot 44. Grooves 46 form a ramp 50 for insertion of pivot 30.

Referring now to FIGS. 4, 5, and 6, the assembly of frame member 14 and door member 12 is illustrated. As depicted in FIG. 4, posts 30 of frame member 14 are moved into slot 44. Opposing grooves 46 capture posts 30; as posts 30 engage ramp 50, assembly aperture 40 is caused to be spread apart, as depicted in FIG. 5. Frame member 14 is further guided into slot 44 until posts 30 are captured in pivot recesses 48. When posts 30 are captured in pivot recesses 48, assembly aperture 40 closes or snaps into a nominal position as depicted in FIG. 6 and indicated by directional arrows 49. According to a preferred embodiment, door member 12 is constructed of a flexible material such as injection molded plastics (such as Delrin), or any of a variety of flexible materials including but not limited to metals, metal alloys, ceramics, polymers, and composite materials. As depicted in FIGS. 4 and 6, assembly aperture 40 is in its nominal state having a gap; however it should be noted that it is not necessary that any substantial gap exist between the two portions of door member 12. As depicted in FIG. 3, assembly aperture 40 is in a preferred position because the proximity to slot 44 requires less force to deform door member 12 to receive posts 30. Alternatively, assembly aperture 40 could be located in a variety of other locations around mounting cup 22 as long as receiving area 42 is able to be deformed to receive posts 30. According to a preferred embodiment, recess 23 in door 16 may capture mounting cup 22 such that the flexure of door member 20 is limited and posts 30 remain captured in door member 20.

Figure 7:
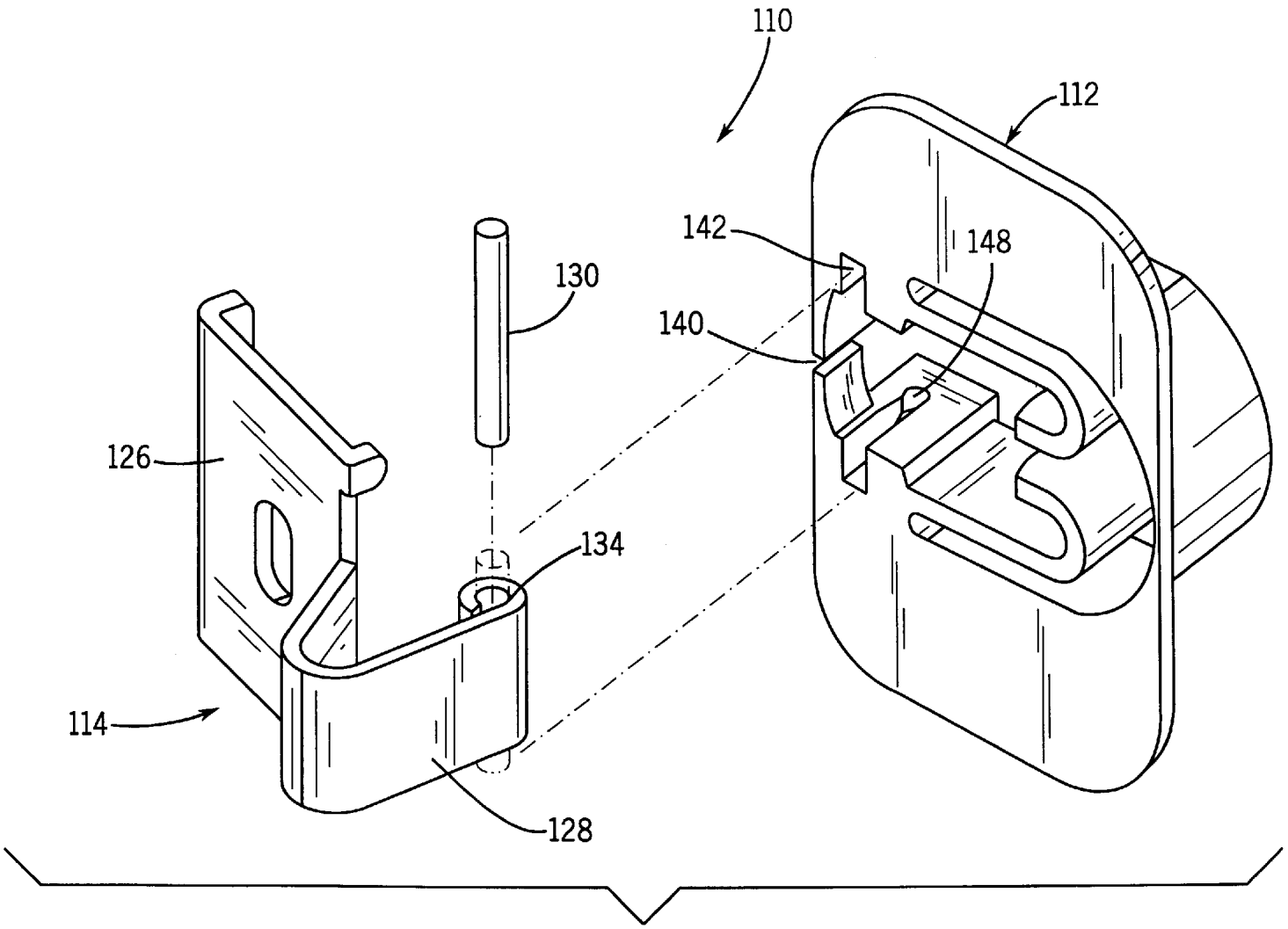
FIG. 7 is an exploded perspective view of an alternative embodiment of the present invention having a separate pivot pin.

According to an alternative embodiment of a hinge 110 shown in FIG. 7, a frame member 114 includes a frame wing 126 and a hinge arm 128. Hinge arm 128 includes a curl 134 at an end opposite of frame wing 126. Curl 134 is configured to accept a pivot pin, shown as an axle 130, inserted axially through curl 134. Hinge 110 also includes a door member 112. To assemble hinge 110, axle 130 is first inserted into curl 134 of hinge arm 128. The combination of hinge arm 128 and axle 130 are then inserted into a receiving area 142 of door member 112. As described with respect to FIGS. 4, 5, and 6, an assembly aperture 140 is spread apart as hinge arm 128 and axle 130 are inserted into receiving area 142 until axle 130 is engaged into pivot recesses 148.

As depicted in FIGS. 8, 9, and 10, the self-closing/self-latching mechanism is depicted in operation. Door member 12 includes spring arms 54 that are preferably integrally formed with door member 12. However, spring arms 54 may be separate members made from different materials than door member 12. Spring arms 54 provide the self-closing/self-latching force. According to an alternative embodiment, the spring arms may be substituted by other spring configurations including but not limited to a single spring arm, coil springs, leaf springs, or any other applicable spring type. FIG. 10 depicts hinge 10 in a fully open position. Spring arms 54 are not in contact with detent lugs 56, so no force is acting on door 16 in this position. As door 16 is closed, as depicted in FIG. 9, spring arms 54 are initially pushed outward by hinge arm 28 coacting with a surface of detent lugs 56, as shown in FIG. 9. As door 16 is further closed, detent lugs 56 continue to engage hinge arm 28 and exert the closing force on door 16. In the closed position, depicted in FIG. 8, spring arms 54 continue to exert force on hinge arm 28 to keep door 16 latched. As door 16 is opened, spring arms 54 oppose the motion of the door until hinge arm 28 disengages from detent lugs 56 such that force is no longer applied.

According to a preferred embodiment, the method of assembly of the concealed self-closing/self-latching hinge provides that door member 12 may be expanded to allow easy insertion of hinge arm 28 and posts 30 such that assembly may be done by hand after manufacture of the components. According to a preferred embodiment in which a pivot pin (axle) is not required, the number of components of the hinge is reduced (e.g. from three to two). According to an alternative embodiment, for example as shown in FIG. 7, if axle 130 is used rather than integral posts 30, frame member 14 may still be inserted into the door member 12 by hand.

Referring now to FIGS. 11 and 12, an alternative embodiment of a hinge 200 is depicted. Hinge 200 includes a frame member 210 and a door member 230. Frame member 210 has a frame wing 212 for coupling to a cabinet frame and a hinge arm 214 for coupling to door member 230. Hinge arm 214 has a curved section 216 and a flat section 218. Flat section 218 includes two hinge pins 219 extending therefrom. Hinge pins 219 are full round hinge pins being substantially cylindrically shaped.

Door member 230 includes a mounting flange 232 and a mounting cup 234. Mounting flange 232 couples door member 230 to a cabinet door via fasteners, such as screws or other appropriate fasteners. Mounting cup 234 fits into a recess or a bore in a cabinet door.

Door member 230 includes a receiving area 236 configured to accept pivots, shown as pins 219. Pins 219 are inserted through receiving area 236 and retained by pivot recesses 238.

As depicted in FIG. 11, mounting cup 234 includes a perimeter which is not fully continuous because of assembly aperture 240. Mounting cup 234 includes on the interior, a receiving area 236. Receiving area 236 is located near the perimeter of door member 230 such that pins 219 will cause hinge arm 214 to move toward the middle of door member 230 when an attached cabinet door is being closed. According to a preferred embodiment, receiving area 236 includes a slot 237, extending from the surface of mounting flange 232 into mounting cup 234. Slot 237 may be made of opposing grooves with opposing pivot recesses 238.

Slot 237 is configured to engage pins 219. As pins 219 engage slot 237, assembly aperture 240 is caused to be spread apart. Frame member 210 is further guided into slot 237 until pins 219 are captured in pivot recesses 238. When pins 219 are captured in pivot recesses 238, assembly aperture 240 closes or snaps into a nominal position.

Door member 230 includes spring arms 254 that are preferably integrally formed with door member 230. Spring arms 254 provide the self-closing/self-latching force. As a cabinet door attached to door member 230 is closed, spring arms 254 are initially pushed outward by curved section 216 of hinge arm 214 coacting with a surface of spring arms 254. It should be noted that spring arms 254 do not have detent lugs as depicted in FIGS. 8 through 10. Instead, hinge arm 214 uses a flat section 214 in combination with curved section 216 to engage spring arms 254 and cause the self-closing/self-latching effect.

Door member 230 includes integrally molded dowels 260, each dowel having a set of ridges 262. Dowels 260 are configured to be inserted into bores in a door for mounting and substantially affixing door member 230 thereto. Integrally molded dowels 260 may be used to replace mounting screws, such as mounting screws 24 depicted in FIGS. 1 and 2. Small indentations 261 are provided at the center of dowel locations, to facilitate removal with a drill if necessary. Furthermore, it may be preferable to include more indentations 261 than dowels 260 (as depicted in FIGS. 11 and 12) so that during manufacture if alternative dowel locations are to be used, only the bottom half of a mold or die needs to be changed.

Referring now to FIGS. 13–21, an alternative embodiment of a hinge 300 is depicted. Hinge 300 includes a frame member 310 and a door member 330. Frame member 310 has a frame wing 312 for coupling to a cabinet frame and a hinge arm 314 for coupling to door member 330. As depicted in FIG. 14, hinge arm 314 has a curved section 316 and a flat section 318. Flat section 318 includes a single hinge pin 319 extending therefrom. Hinge pin 319 is depicted as a full round hinge pin being substantially cylindrically shaped, however hinge pin 319 may be any suitable shape including but not limited to half round, partially round or having a polygonal cross section.

Door member 330 includes a mounting flange 332 and a mounting cup 334. Mounting flange 332 couples door member 330 to a cabinet door 331 via fasteners, such as screws, or other appropriate fasteners. Mounting cup 334 fits into a recess or bore 335 in cabinet door 331. As depicted in FIG. 14, hinge 300 is readily assembled after installed on door member 330 in door 331 and after installing frame member 312 on frame 313, as depicted in FIG. 14 by line 337. Line 337 depicts a possible path of travel for pin 319 during assembly of hinge 300. Pin 319 is inserted into cup 334 and subsequently inserted into a pin recess 338. When assembled, hinge 300 appears as depicted in FIG. 13 having door 331 in an open position. Frame member 310 and door member 330 are held together by the force of gravity acting on door 331 in the direction opposite the extension of pin 319. Thus, the force of gravity on door 331 substantially maintains pin 319 in pin recess 338.

As depicted in FIG. 14, door member 330 has a slot 340 corresponding to a door 331 open position. When door 331 is in an open position, as depicted in FIGS. 13 and 17, upper edge 341 rests within slot 340 to maintain door 331 in a substantially open position. Further, as depicted in FIG. 17, slot 340 corresponds to door 331 being in the substantially open position.

As depicted in FIGS. 14–17, door member 330 includes a cam surface 342 having a substantially planar portion 343 and a ramped portion 344.

As door 331 moves from the substantially open position, depicted in FIG. 17, to a substantially closed position, depicted as FIG. 15, upper edge 341 of frame member, flat portion 318 of frame member 310 is forced out of slot 340 and rides along flat surface 342 (depicted as an intermediate position or partially open position in FIG. 16) and further down ramp 344 until it reaches a substantially closed, as depicted in FIG. 15. Ramp 344 provides a self-closing force on door 331 due to gravity acting on door 331 and therefore pulling door 331 down ramp 344.

Figure 19:
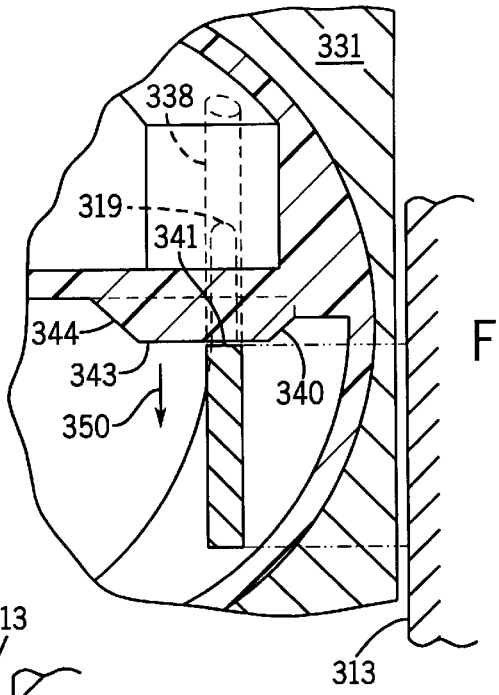
FIG. 19 is a partial cross sectional view of the door member taken across the line 19—19 of FIG. 16.
Figure 18:
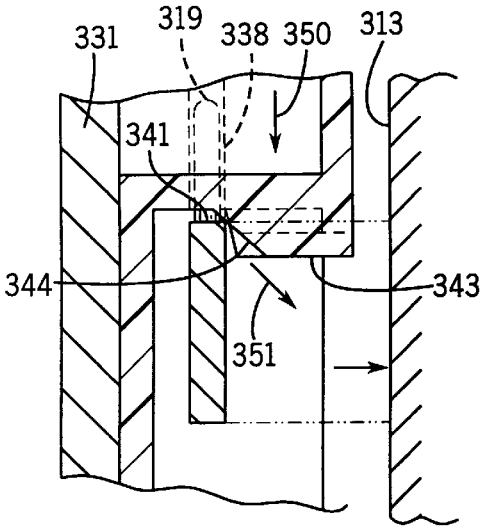
FIG. 18 is a partial cross sectional view of the door member taken across the line 18—18 of FIG. 15.
Figure 20:
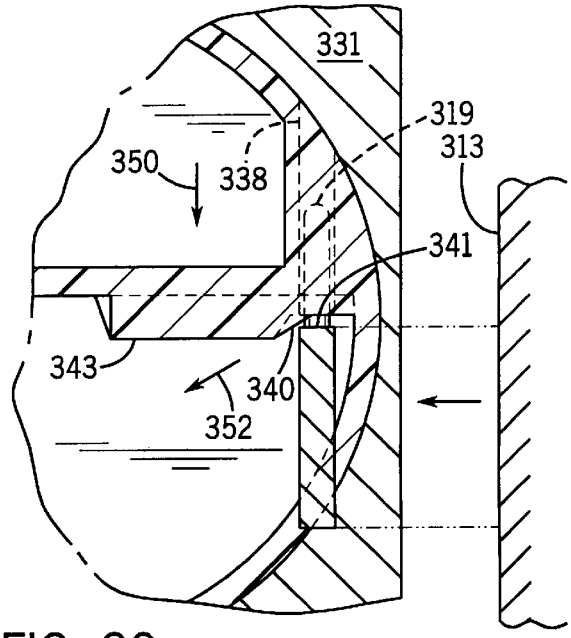
FIG. 20 is a partial cross sectional view of the door member taken across the line 20—20 of FIG. 17.

FIGS. 18–20 depict the direction of the force of gravity by arrows 350. The direction of gravity 350 provides the self-closing action for hinge 300. Directional arrow 351 depicts the relative direction of movement of frame member 310 relative to door member 330 as door 331 is being opened. As depicted in FIG. 20, directional arrow 352 depicts the relative motion of frame member 310 with respect to door member 330 while upper edge 341 of frame member 310 disengages slot 340.

Figure 21:
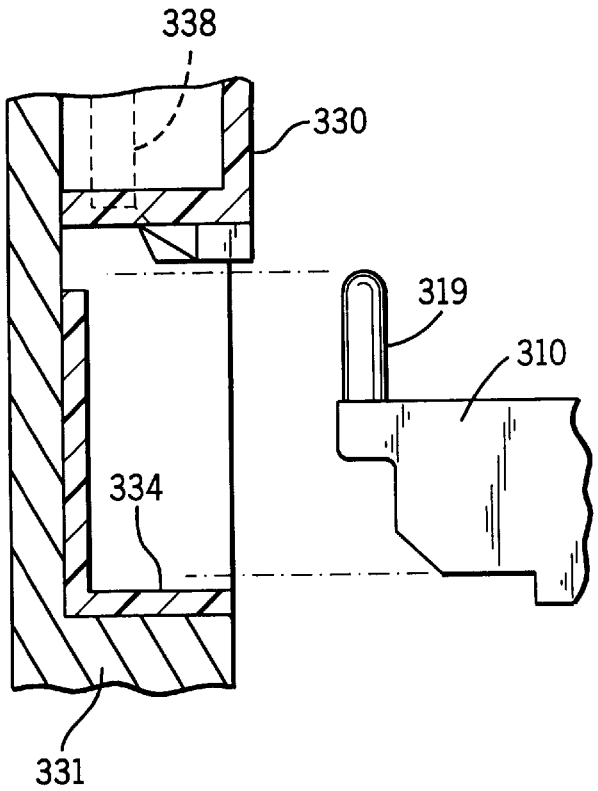
FIG. 21 is a partial cross sectional view of the door member of the hinge of FIG. 13 showing the frame member disengaged from the door member.

FIG. 21 depicts the assembly of frame member 310 with door member 330. During assembly pin 319 is inserted into cup 344 and further into pin recess 338 whereby the force of gravity on door 331 substantially holds pin 319 within pin recess 338.

Figure 24:
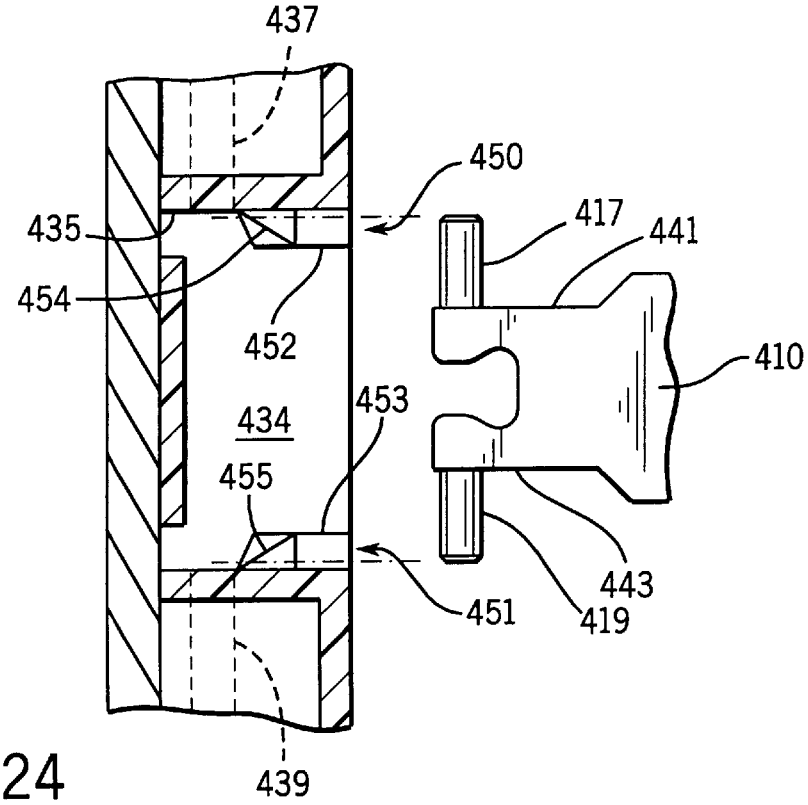
FIG. 24 is a cross sectional view of the door member taken across the line 24—24 of FIG. 23.
Figure 22:
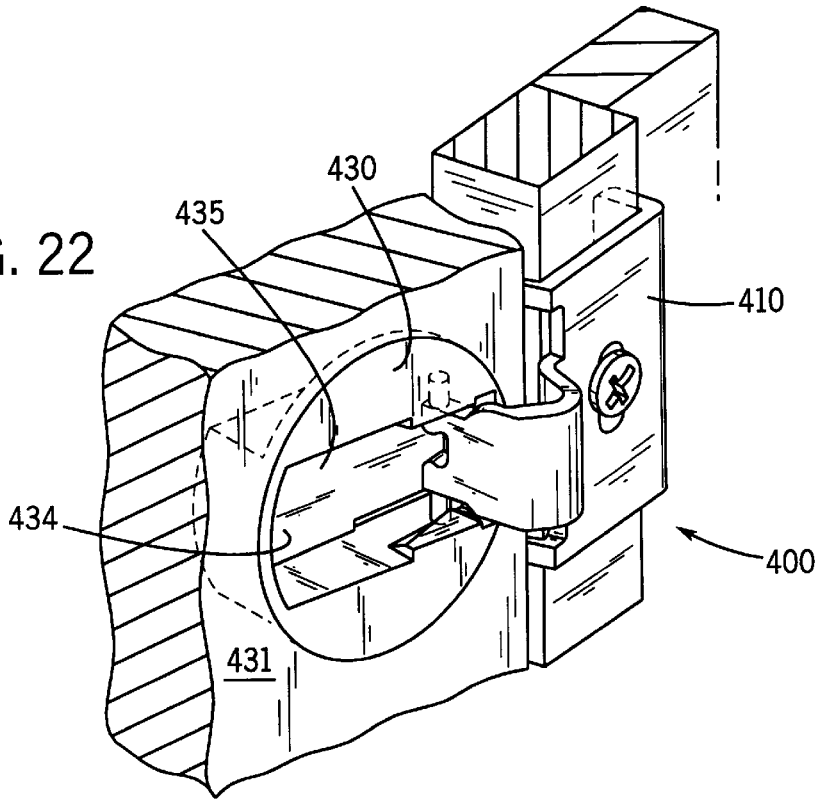
FIG. 22 is a perspective view of an alternative embodiment of the hinge.
Figure 23:
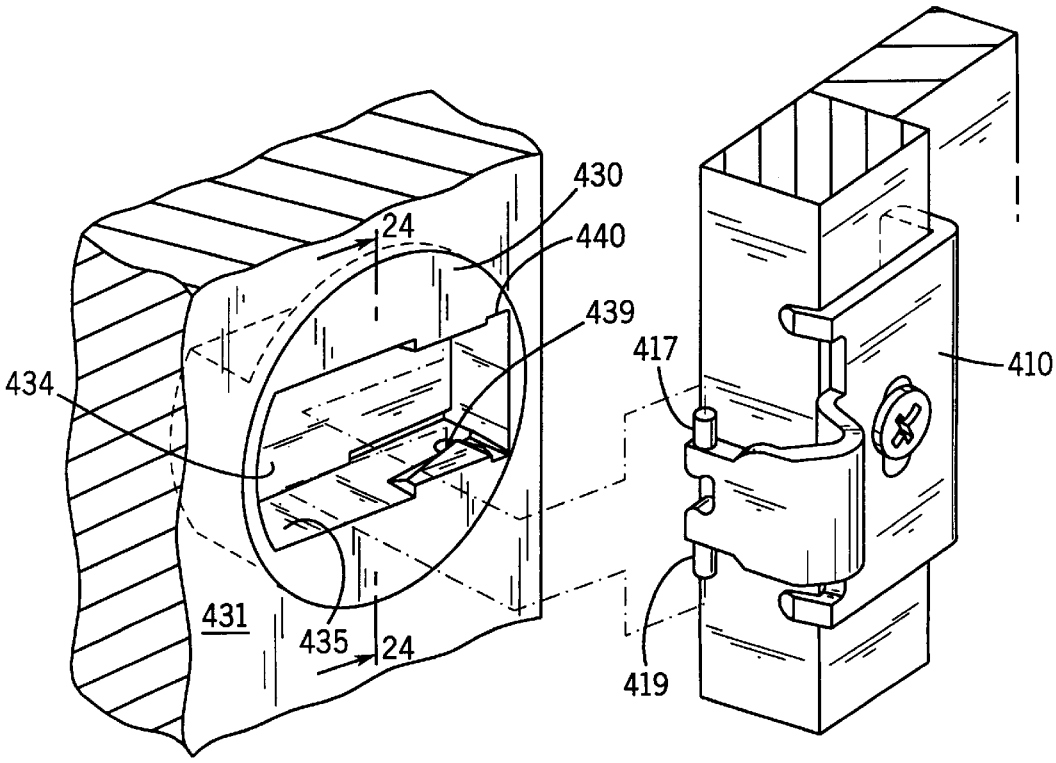
FIG. 23 is a perspective view of the hinge of FIG. 22 showing the frame member disengaged from the door member.

Referring now to FIGS. 22–24 an alternative embodiment of hinge 400 is shown. Hinge 400 operates similar to hinge 300 in that it uses the force of gravity on a door 431 to provide a self-closing force. As depicted in FIG. 22, hinge 400 includes a frame member 410 having a pair of hinge pins 417 and 419. (Hinge pins 417 and 419 extend from frame wing 410). In one embodiment, hinge pins 417 and 419 span a distance which is slightly less than the width of an aperture 435 formed in a cup 434 of a door member 430. Further, in another embodiment, hinge pins 417 and 419 span a distance that is slightly larger than the width of aperture 435. The distance that pins 417 that is slightly larger than the width of aperture 435. The distance that pins 417 and 419 span therefore may be smaller than the width of aperture 435 or slightly greater than the width of aperture 435, as long as pins 417 and 419 may be inserted into aperture 435 and may be further inserted into at least one of two pin recesses 437 and 439.

Once frame member 410 is inserted into aperture 435, with hinge pin 417 inserted into pin recess 437 with door 431 in a substantially open position an upper edge 441 of frame member 410 rests substantially in a slot 440. When door 431 is in the substantially open position, pin 419 partially inserted into pin recess 439.

Hinge 400 has dual cam surfaces 450 and 451, each cam surface having a substantially flat portion 452 and 453 respectively and a ramped portion 454 and 455 respectively. As door 431 is moved from the substantially open position to the substantially closed position, upper edge 441 of frame member 410 rides along (i.e., engages, or slides relative to) substantially flat portion 452 likewise a lower edge 443 of frame member 410 rides along or near substantially flat portion 453 of cam surface 451. As door 431 is further closed, upper edge 431 engages ramp 454 which provides a self-closing force and pushes pin 417 further into pin recess 437 while retracting pin 419 either fully or partially from pin recess 439.

It should be appreciated that both hinges 300 and 400 may be easily assembled and disassembled after manufacture of the separate hinge pieces (frame member and door member) further, it should be appreciated that frame members 310 and 410 and door members 330 and 430 may be assembled onto a frame and door respectively before assembling respective hinges 300 and 400. Thus, a door 331 or 431 using respective hinges 300 and 400 may be easily removed from the frame of the cabinet by simply disassembling the two hinge portions (frame member and door member) without removing either of the hinge portions (frame member and door member) from the frame or from the door.

The hinge described above may be suitably used in a variety of door/frame arrangements including but not limited to any of a variety of cabinets, such as kitchen cabinets, bathroom cabinets, and furniture cabinets having doors attached to a cabinet frame. Further, the hinge described above uses a deformable door member and a substantially rigid frame member. Alternatively, a substantially rigid door member may be used in combination with a deformable frame member to achieve the same effect of assembly or disassembly by an end user.

The method of assembly of the hinge according to preferred and alternative embodiments may be performed in various steps; any omissions or additions of steps to those steps disclosed, or any departure from the order or sequence of steps recited, should be considered to fit within the spirit and scope of the invention.

In the claims, each means-plus-function clause is intended to cover the structures described herein as performing the recited function and not only structural equivalents but also equivalent structures.

While the detailed drawings, specific examples, and particular formulations given describe preferred embodiments of the present invention, they serve the purpose of illustration only. The materials and configurations shown and described may differ depending on the chosen performance characteristics and physical characteristics of the door and frame. For example, the method of attaching the frame member and door member to the frame and door respectively could differ, using adhesives or interference fits rather than screws. As another example, the self-closing mechanism could be effected through the use of one spring arm rather than two, or even a magnetic or other type of force rather than a spring force. The apparatus of the invention is not limited to the precise details and conditions disclosed. Furthermore, other substitutions, modifications, changes, and omissions may be made in the design, operating conditions and arrangement of the preferred embodiments without departing from the spirit of the invention as expressed in the appended claims.

What is claimed is:

1. A hinge for mounting a door to a frame, comprising:

a door member configured to be mounted on the door;

a frame member pivotally coupled to the door member by a pivot; and a receiving area in the door member configured to receive the pivot; wherein the door member and the frame member are configured to be assembled by spreading open the receiving area to allow passage of the pivot into the receiving area;

an aperture in the door member that allows the receiving area to be spread open.

2. The hinge of claim 1 wherein the receiving area has a slot for guiding the pivot.

3. The hinge of claim 1 wherein the door member is flexible.

4. The hinge of claim 3 wherein the door member is made of a polymeric material.

5. The hinge of claim 1 wherein the pivot is integral to the frame member.

6. The hinge of claim 1 wherein the pivot is a pivot pin.

7. A hinge for mounting a door to a frame, comprising:

a door member configured to be mounted on the door;

a frame member pivotally coupled to the door member by a pivot; and a receiving area in the door member configured to receive the pivot;

wherein the door member and the frame member are configured to be assembled by spreading open the receiving area to allow passage of the pivot into the receiving area;

wherein the frame member includes an aperture for mounting the frame member to the frame.

8. A hinge for mounting a door to a frame, comprising:

a door member configured to be mounted on the door;

a frame member pivotally coupled to the door member by a pivot; and a receiving area in the door member configured to receive the pivot;

wherein the door member and the frame member are configured to be assembled by spreading open the receiving area to allow passage of the pivot into the receiving area;

wherein the receiving area has two bores to capture the pivot.

9. A hinge for mounting a door to a frame, comprising:

a flexible door member configured to be mounted on the door;

a frame member pivotally coupled to the door member by a pivot means; and an aperture in the door member configured to allow the door member to be flexed from a substantially first state to a deformed state for insertion of the pivot means into the door member, wherein the door member may be moved to the substantially first state after insertion of the pivot means to capture the pivot means and the door member has two bores to retain the pivot means.

10. A hinge for mounting a door to a frame, comprising:

a flexible door member configured to be mounted on the door;

a frame member pivotally coupled to the door member by a pivot means; and an aperture in the door member configured to allow the door member to be flexed from a substantially first state to a deformed state for insertion of the pivot means into the door member, wherein the door member may be moved to the substantially first state after insertion of the pivot means to capture the pivot means and the door member is configured to be inserted into a recess in the door to maintain the door member in the substantially first state, thereby substantially retaining the pivot means.

11. The hinge of claim 10 wherein the door member has a slot for receiving the pivot means.

12. The hinge of claim 11 wherein the slot has opposed ramps to deform the door member when the pivot means engages the ramps.

13. The hinge of claim 10 wherein the door member is made of a polymeric material.

14. The hinge of claim 10 wherein the frame member has an integral pivot means.

15. The hinge of claim 10 wherein the pivot means is a pin.

16. A hinge for mounting a door to a frame, comprising:

a flexible door member configured to be mounted on the door;

a frame member pivotally coupled to the door member by a pivot means; and an aperture in the door member configured to allow the door member to be flexed from a substantially first state to a deformed state for insertion of the pivot means into the door member, wherein the door member may be moved to the substantially first state after insertion of the pivot means to capture the pivot means and the frame member includes a slotted aperture for mounting to the frame.

17. A concealed hinge comprising:

a door member configured to be coupled to a door;

a frame member configured to be coupled to a frame; and a cam surface provided on one of the door member and the frame member, the cam surface engageable with the other of the door member and the frame member, the cam surface configured to develop at least a partial closing force of the door relative to the frame, wherein the door member and the frame member are configured to be selectively pivotally coupled and decoupled, wherein the frame member deforms to allow pivotal coupling of the door member and the frame member.

18. The concealed hinge of claim 17 wherein the frame member captures the door member after coupling.

19. A method for assembling a hinge, comprising the steps of:

enlarging a receiving area in a door member to allow passage of a pivot coupled to a frame member;

inserting the pivot of the frame member into the receiving area of the door member; and causing the door member to substantially retain its nominal shape to capture the pivot of the frame member in the receiving area of the door member.

20. The method for assembling the hinge of claim 19 further comprising:

pressing the pivot against opposed ramps in the receiving area to enlarge the receiving area.

21. The method for assembling the hinge of claim 19 further comprising:

coupling a pivot pin to the frame member.

22. A concealed hinge comprising:

a door member configured to be coupled to a door;

a frame member configured to be coupled to a frame; and a cam surface provided on one of the door member and the frame member, the cam surface engageable with the other of the door member and the frame member, the cam surface configured to develop at least a partial closing force of the door relative to the frame, wherein the door member and the frame member are configured to be directly selectively pivotally coupled and decoupled.

23. A concealed hinge comprising:

a door member configured to be coupled to a door;

a frame member configured to be coupled to a frame; and a cam surface provided on one of the door member and the frame member, the cam surface engageable with the other of the door member and the frame member, the cam surface configured to develop at least a partial closing force of the door relative to the frame, wherein the door member and the frame member are configured to be selectively pivotally coupled and decoupled, wherein the door member deforms to allow pivotal coupling of the door member and the frame member.

24. The concealed hinge of claim 23 wherein the door member captures the frame member after coupling.

25. The concealed hinge of claim 22 wherein the door member and the frame member may be assembled by hand.

26. The concealed hinge of claim 22 wherein the door member and the frame member may be disassembled by hand.

27. The concealed hinge of claim 22 wherein the door member and the frame member may be assembled by an end user.

28. The concealed hinge of claim 22 wherein the door member and the frame member may be disassembled by an end user.

29. The concealed hinge of claim 22 whereby the door member and frame member may be selectively pivotally coupled and decoupled after the door member has been coupled to the door and the frame member has been coupled to the frame.

30. The concealed hinge of claim 22 wherein the frame member includes a single pivot.

31. The concealed hinge of claim 30 wherein the cam surface has a ramp.

32. The concealed hinge of claim 31 wherein the cam surface has a slot.

33. A concealed hinge comprising:

a door member configured to be coupled to a door;

a frame member configured to be coupled to a frame; and a cam surface provided on one of the door member and the frame member, the cam surface engageable with the other of the door member and the frame member, the cam surface configured to develop at least a partial closing force of the door relative to the frame, wherein the door member and the frame member are configured to be selectively pivotally coupled and decoupled, wherein the frame member includes a single pivot, wherein the cam surface has a ramp, wherein the at least partial closing force is developed by the ramp in combination with the force of gravity.

* * * * *